United States Patent [19]

Meier

[11] Patent Number: 4,606,265

[45] Date of Patent: Aug. 19, 1986

[54] APPARATUS FOR CRUSHING CANS

[76] Inventor: Herman C. Meier, RD Box 31 Flint Mine Rd., Coxsackie, N.Y. 12051

[21] Appl. No.: 665,070

[22] Filed: Oct. 26, 1984

[51] Int. Cl.[4] ..... B30B 9/32

[52] U.S. Cl. ..... 100/53; 100/99; 100/255; 100/266; 100/288; 100/902

[58] Field of Search ..... 100/902, 99, 288, 266, 100/255, 53

[56] References Cited

U.S. PATENT DOCUMENTS

| | | | |
|---|---|---|---|
| 2,737,995 | 3/1956 | Jennings | 100/902 X |
| 3,204,550 | 9/1965 | Swiderski | 100/902 X |
| 3,580,167 | 5/1971 | Simshauser | 100/902 X |
| 3,659,520 | 5/1972 | Garrett | 100/902 X |
| 3,817,169 | 6/1974 | Bischoff | 100/902 X |
| 3,857,334 | 12/1974 | Arp | 100/902 X |
| 4,103,609 | 8/1978 | Hiatt | 100/902 X |
| 4,141,493 | 2/1979 | Arp | 100/902 X |
| 4,216,713 | 8/1980 | Jung | 100/902 X |
| 4,235,164 | 11/1980 | Allen | 100/902 X |

*Primary Examiner*—Billy J. Wilhite

*Attorney, Agent, or Firm*—Gerhard K. Adam

[57] ABSTRACT

An apparatus is disclosed for crushing aluminum beverage cans after the contents have been emptied. The can crusher includes a frame having an anvil mounted at one end thereof and a movable ram positioned on the frame and facing the anvil, a crushing chamber is affixed to the frame for supporting the can between the anvil and the ram and a means is provided for moving the ram toward the anvil and then away from the anvil.

10 Claims, 12 Drawing Figures

FIG. 5
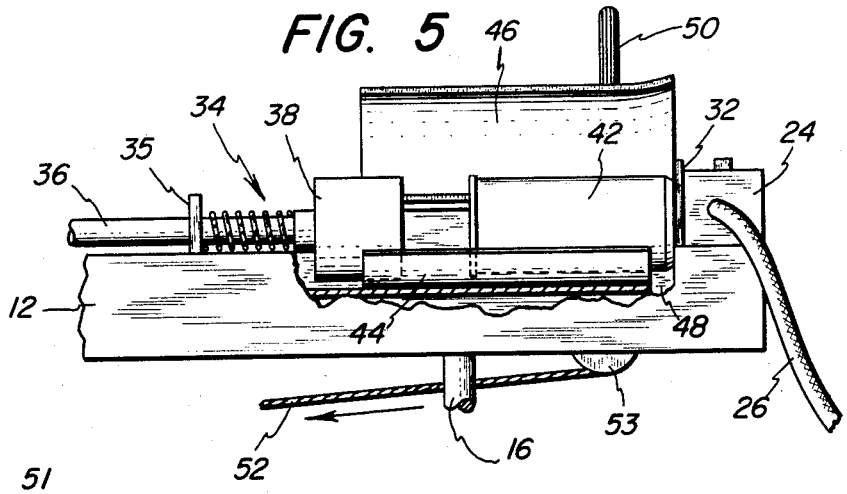
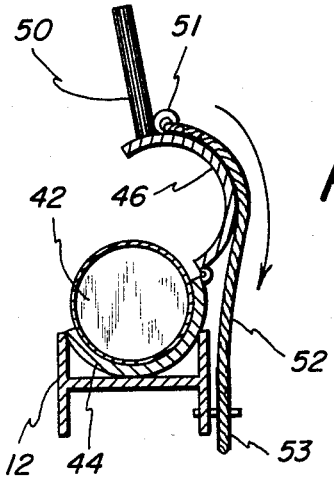
FIG. 6
FIG. 7
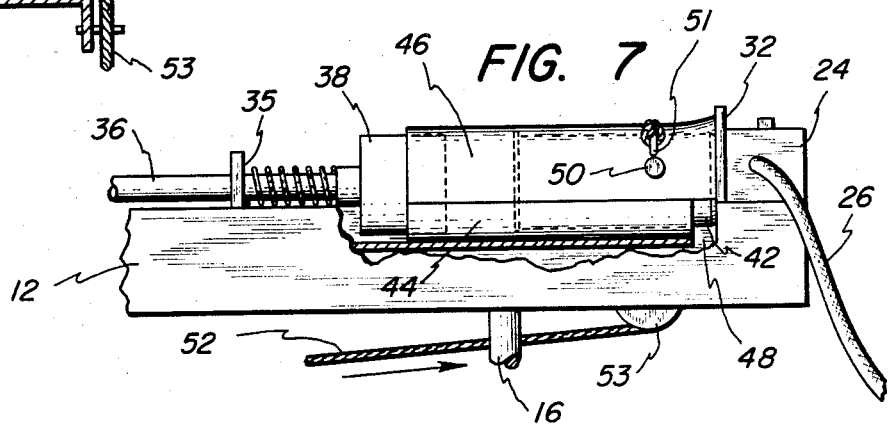
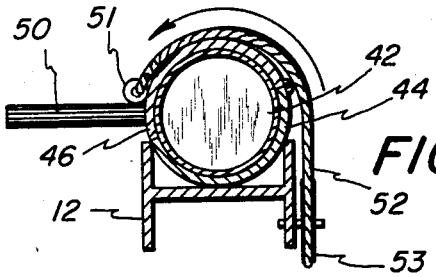
FIG. 8

APPARATUS FOR CRUSHING CANS

BACKGROUND OF THE INVENTION

1. Field of the Invention

This invention relates to a can crusher and more particularly to an apparatus for crushing beverage cans and the like.

2. Description of the Prior Art

Large quantities of carbonated beverages, such as beer and soda, are sold in aluminum cans. A real problem has been created in the disposal of the empty containers, many of which have littered our parks and roads. In order to encourage people to return the empty cans, a number of states have enacted laws to require a deposit for each can. Further, these aluminum cans may be sent to manufacturing plants for recycling.

However, the empty beverage cans occupy a substantial space so that storage and transportation becomes an expensive and clumsy operation. Devices for crushing cans and thereby making it possible to pack many more empty cans into the same space have been disclosed in the prior art, examples of which may be found in Simhauser, U.S. Pat. No. 3,580,167; in Bischoff, U.S. Pat. No. 3,817,169; in Arp et al, U.S. Pat. No. 3,857,334; in Arp, U.S. Pat. No. 4,141,493; in Jung, U.S. Pat. No. 4,216,713; and in Allen et al, U.S. Pat. No. 4,235,164.

It is therefor an object of the present invention to provide an apparatus for crushing beverage cans.

It is another object of the invention to provide a can crushing apparatus which is operated by an electric motor.

SUMMARY OF THE INVENTION

In accordance with the present invention, I have discovered an apparatus for crushing cans which includes a horizontal frame mounted on a base by a plurality of legs. A stationary anvil is mounted at one end of the frame and a sliding ram is slidably mounted on the frame and facing the anvil. Between the anvil and the ram, there is a can crushing chamber for supporting the can while it is being inserted in the crusher and during the crushing operation. The ram is driven against the stationary anvil by a ram drive means which is mounted to the frame and operatively connected to the sliding ram, whereby when the can is placed in the support means, it may be crushed between the sliding ram and the anvil. The ram is then returned to its original position to allow removal of the crushed can and then a counter, attached to the frame, counts the number of cans crushed by monitoring each cycle of movement of the ram against the anvil.

BRIEF DESCRIPTION OF THE DRAWINGS

My invention is more clearly understood from the following description taken in conjunction with the accompanying drawing in which:

FIG. 5 is a fragmentary side view of the crushing chamber in the open position.

FIG. 6 is a fragmentary cross sectional view of the crushing chamber as shown in FIG. 5.

FIG. 7 is a fragmentary side view of the crushing chamber in the closed position.

FIG. 8 is a fragmentary cross sectional view of the crushing chamber as shown in FIG. 7.

DETAILED DESCRIPTION OF THE DRAWING

Figure 1:
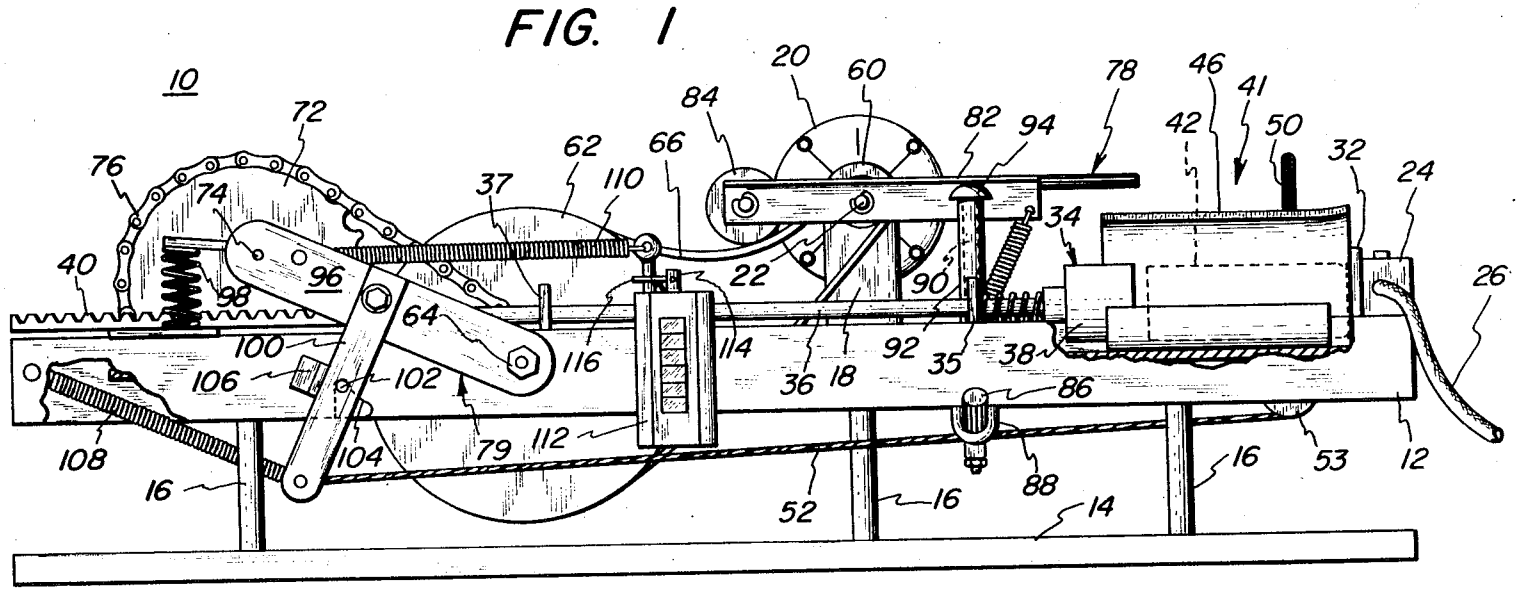
FIG. 1 is a side elevational view of the can crushing apparatus of the present invention with the ram in the home position.

The apparatus shown in the drawings is adapted to crush or flatten metal cans used as conventional beverage cans of the size containing twelve ounces when they are filled. The device is readily adapted to receive and crush cans of the size containing sixteen ounces. The empty containers were formerly just thrown away and many of them littered our streets and highways. Recently, Bottle Bills have been enacted by a number of states which require that a return deposit be placed on each can in order to encourage the consumer to return the empty can to the vendor.

Referring primarily to FIGS. 1,2,3 and 4, it will be seen that the can crushing apparatus 10 of the invention is supported on horizontal frame 12 affixed to base 14 by means of plurality of legs 16. As is illustrated, the frame 12 is formed from an I-beam with a motor mounting bracket 18 rigidly affixed thereto as by welding. Legs 16 are threaded at the bottom and attached to base 14 by means of nuts and washers (not shown) and are welded at the top to horizontal frame 12. While the number of legs 16 is not critical, the illustration shows three legs 16 with one located at each end of frame 12 and the third leg 16 attached under motor mounting bracket 18 on which is rigidly mounted a drive motor 20 having a motor shaft 22. On-off switch 24 with line cord 26 for drive motor 20 is conveniently mounted on frame 12.

As shown, the crushing zone 30 is defined by a stationary anvil 32, that is mounted near one end of the frame 12 and along side of switch 24, and held with sufficient rigidity that it provides a backstop for a movable ram assembly 34 to be used as a crushing member. The ram assembly 34 includes a ram rod 36 having a ram head 38 connected at one end and a rack gear 40 connected to the other end. The ram rod 36 is slidably mounted to frame 12 ram rod guides 35 and 37. Preferably, the ram head 38 is in the form of a cylindrical tube in which the central portion is a hollow space. This conforms to the crushing action which actually crushes only the outer side walls of can 42 and not the top or bottom and permits can 42 to be crushed regardless whether a small amount of liquid remains in can 42.

Crushing chamber 41 is cylindrically shaped having an inside diameter sufficient to accommodate can 42. Crushing chamber 41 is affixed to frame 12 for supporting and aligning can 42 between anvil 32 and movable ram head 38. Chamber 41 has a semicylindrical bottom wall 44 and a semicylindrical loading door 46 which is hinged to the bottom wall 44 so that the door 46 may be opened to place can 42 into chamber 41 and then closed while can 42 is being crushed. Drop slot 48 wide enough for removing can 42 from chamber 40, after it has been crushed between ram head 38 and stationary anvil 32, is located in the semicylindrical bottom wall 44 in the area adjacent to stationary anvil 32. The portion of the loading door 46 above the drop slot 48 is beveled out slightly to permit the can 42 to drop freely through the drop slot 48 without sticking or being prevented from dropping by door 46. Attached to loading door 46, is handle 50 which facilitates opening and closing door 46, and handle 50 has loop 51 on the end through which cable 52 is attached. The travel of door 46 can be restricted by door stop 54.

The drive means for moving the ram assembly 34 toward anvil 32 to crush cans 42 disposed therebetween is composed of three different mechanisms, namely a belt and pulleys, a chain and chain wheels and a rack and pinion gear. The first drive mechanism includes a driver (small) pulley 60 mounted on motor shaft 22 and driven (large) pulley 62 mounted on first shaft 64. Connecting driver pulley 60 to driven pulley 62 is belt 66 which imparts rotational motion to first shaft 64. The second mechanism includes a first (small) chain wheel 70 mounted on first shaft 64 and second (large) chain wheel 72 mounted on second shaft 74. Drive chain 76 operatively connects first chain wheel 70 to second chain wheel 72 and imparts rotational motion to second shaft 74. The third drive mechanism includes a pinion gear 80 mounted on second drive shaft 74 and movable ram assembly 34 mounted on horizontal frame 12. Ram assembly 34 has ram head 38 mounted at one end and rack gear 40 affixed to the other end. In order for ram assembly 34 to move toward and crush can 42, a succession of events occur starting with motor 20 which drives the belt 66 and pulleys, 60 and 62 which in turn drives chain 76 and chain wheels 70 and 72, and which in turn drives rack gear 40 against pinion gear 80.

A further requirement of this apparatus is that ram assembly 34 move towards anvil 32 only when it is directed to crush can 42 and this function is provided by a first clutch means 78 and a second clutch means 79 for engaging and disengaging the power means provided by drive motor 20. In order to engage and disengage belt 66, friction clutch lever 82 and third pulley 84 are placed between driver pulley 60 and driven pulley 62. This provides sufficient tension on belt 66 and thereby engages pulleys 60 and 62. As shown for convenience the lever 82 pivots on the motor shaft 22, but this is not necessary and lever 82 may be placed at other locations as long as the action of lever 82 increases the tension of belt 66 to prevent slipping thereof. Friction clutch lever assembly 82 includes handle 86 mounted under frame 12 by means of a sleeve 88 and handle 86 is bolted to vertical rod 90 that passes through hollow tubing 92. Rod 90 having a round head 94 which extends above tubing 92. When handle 86 is pushed down, rod 90 travels upward and pivots lever 82 and thereby applies friction to belt 66 which engages pulleys 60 and 62.

The second clutch means 79 engages and disengages pinion gear 80 on rack gear 40. Rack gear 40 is attached to frame 12 on one end of a pivoting mount 96 and is normally maintained in the disengaged position by means of first spring 98.

The other end of pivoting mount 96 is attached to frame 12. U shaped bar 100 is loosely bolted to pivoting mount 96 and has lateral shaft 102 which rides on cam 104 and is prevented from moving beyond a certain point by stop 106. When loading door 46 is closed, cable 52 pulls bar 100 forward causing pivoting mount 96 to rotate counterclockwise and engage pinion gear 80 on rack gear 40. Once engaged, pinion gear 80 drives ram assembly 34 toward anvil 32 in full travel position and crushes can 42. In order for the device to work effectively both clutches means 78 and 79 must be operated simultaneously. After second clutch means 79 is released, spring 98 automatically disengages rack gear 40 and then ram assembly 34 returns to its home position by springs 108 and 110, whereby crushed can 42 is released and falls through drop slot 48.

It is a further embodiment of my invention to provide for counter means 112 for recording the number of cans 42 crushed during operation of the apparatus. A convenient attachment monitors each cyle of movement of the ram assembly 34 against anvil 32. As shown a projection 114 is mounted to the ram assembly 34 and each cycle of the ram assembly 34 trips arm 116 of counter means 112 and thereby increasing the number registered on counter 112.

FIG. 5 shows an enlarged fragmentary side view of the crushing chamber 41 with loading door 46 in the open position and can 42 resting on semicylindrical bottom wall 44. Ram rod 36, having ram head 38 connected thereto and protruding into crushing chamber 41, is in the home position. When handle 50 is used to open loading door 46, cable 52 passing over pulley 53 travels toward U-shaped bar or stirrup 100 as indicated by the arrow. The simplified cross sectional view of crushing chamber 41 in the open position is shown in FIG. 6 with the can resting on bottom wall 44 and loading door 46 opened through hinge 45. Cable 52 attached close to handle 50 by means of loop 51 travels downward over pulley 53.

Figure 2:
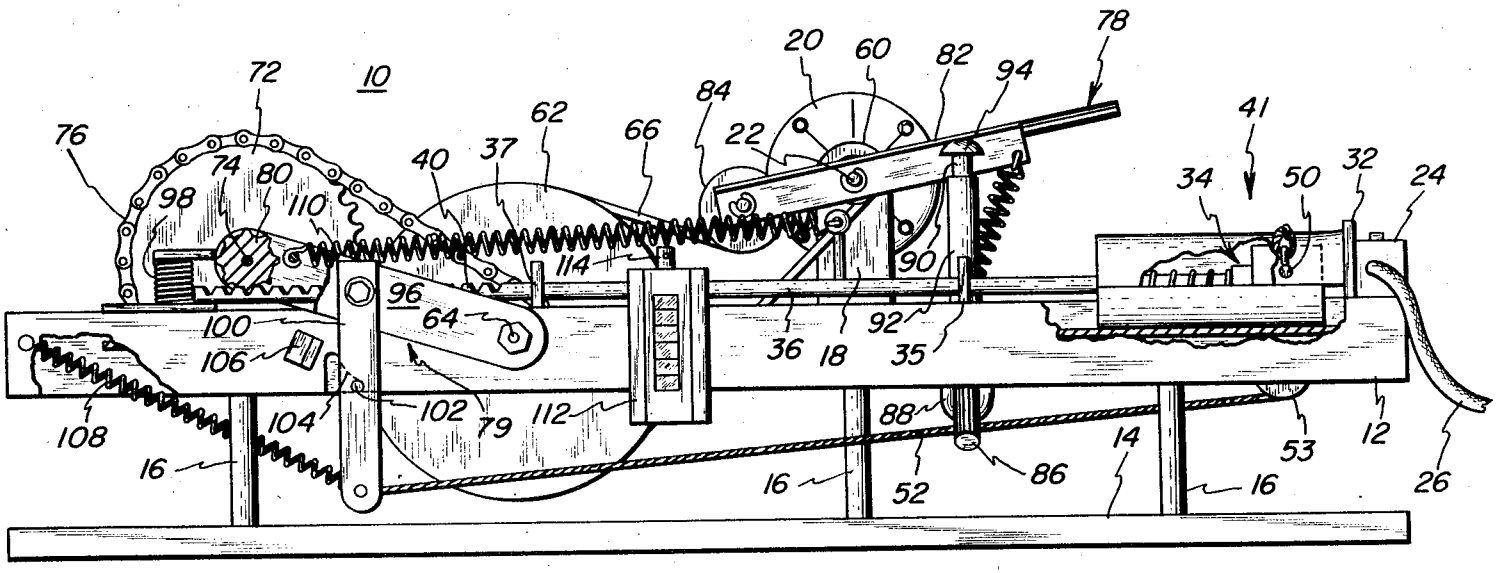
FIG. 2 is a side elevational view of the can crushing apparatus of FIG. 1 with ram in full travel position.
Figure 3:
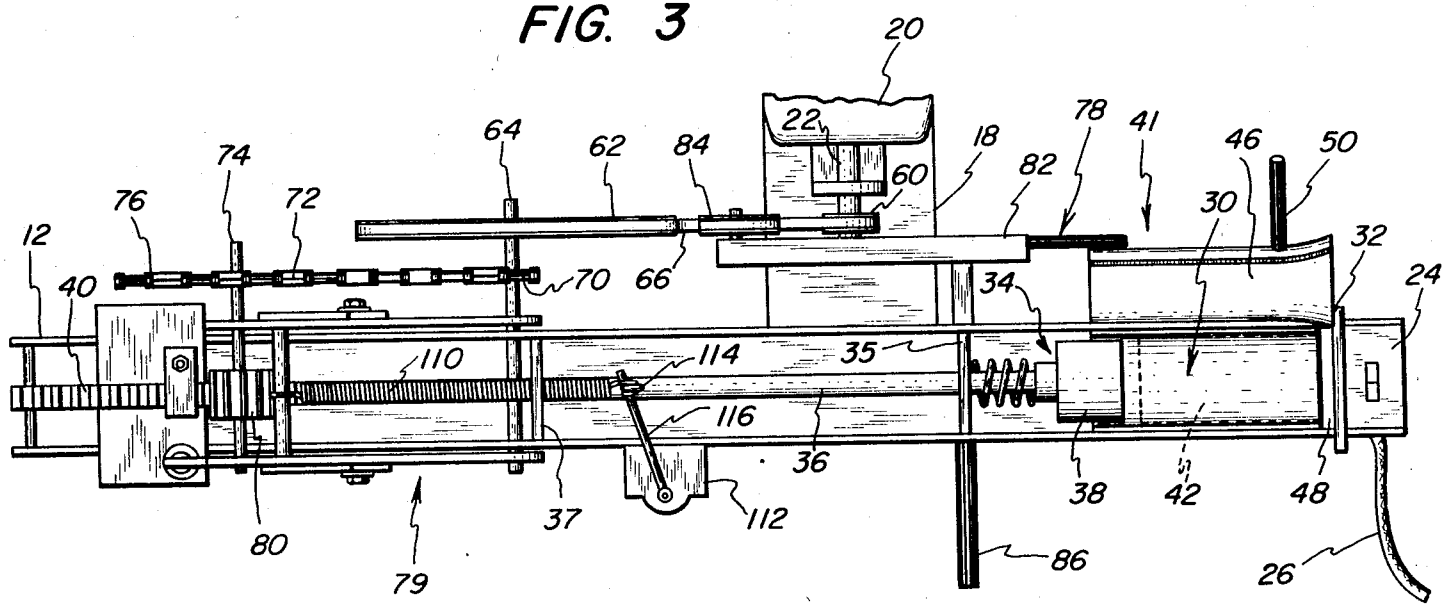
FIG. 3 is a top view of the can crushing apparatus of FIG. 1.
Figure 4:
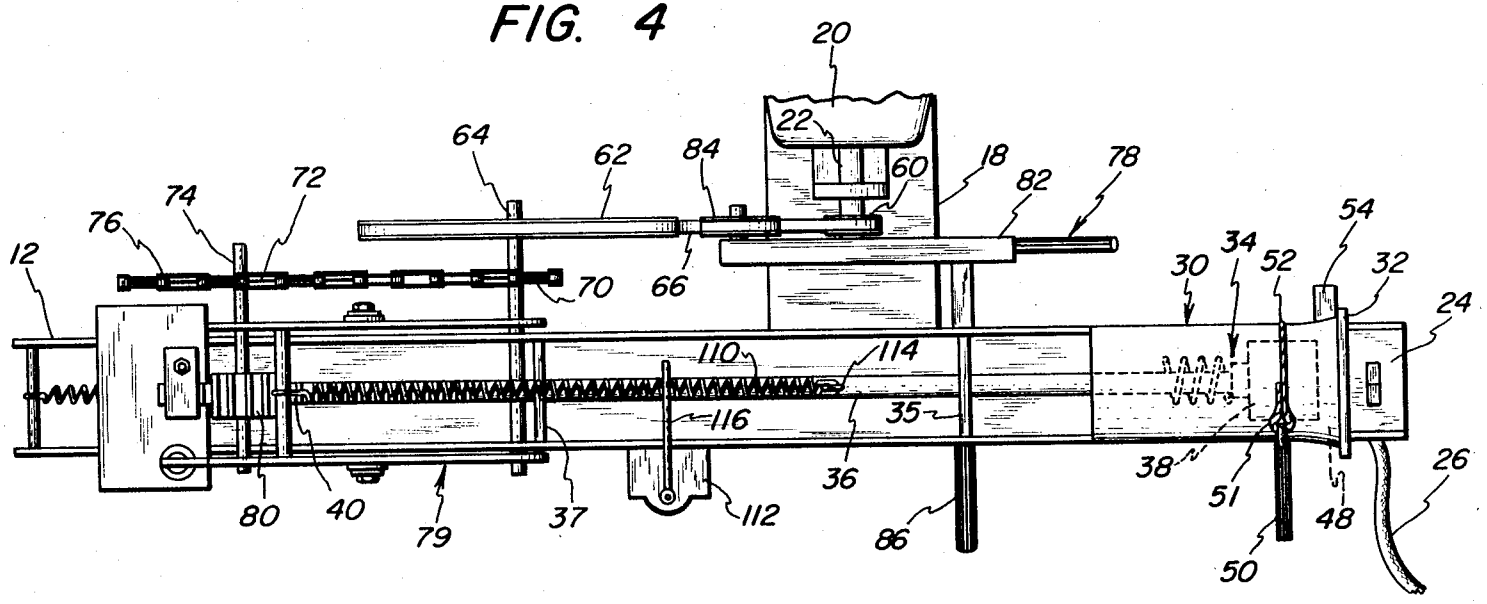
FIG. 4 is a top view of the can crushing apparatus of FIG. 2.

Now referring to FIGS. 7 and 8, the crushing chamber 41 is in the closed position by closing loading door 46 through hinge 45 over bottom wall 44. Ram rod 36 is still in the home position and can 42 rests between ram head 38 and stationary anvil 32. Cable 52 passing over pulley 53 is pulled forward as shown by the arrow and thereby activates the second clutch means 79 to engage the pinion gear 80 on the rack gear 40 as shown in FIG. 2. However, can 42 will not be crushed until first clutch means 78 is activated to provide sufficient tension on belt 66 to drive pulley 62.

Figure 9A:
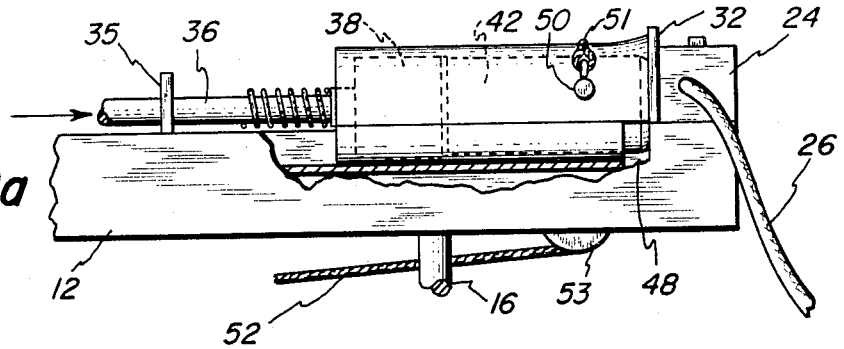
FIGS. 9*a* through 9*d* are fragmentary side views of the crushing chamber showing various stages of the can as it is being crushed and passed through the drop slot.
Figure 9B:
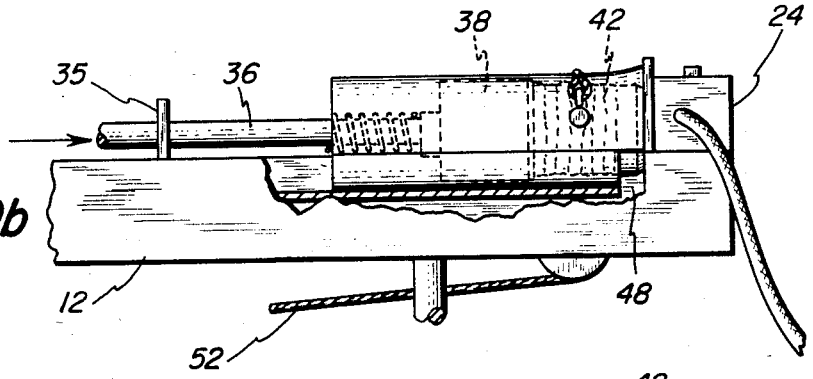
Figure 9C:
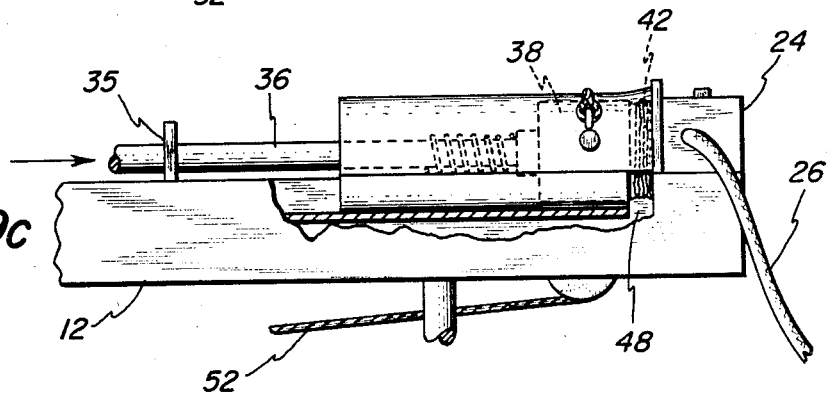
Figure 9D:
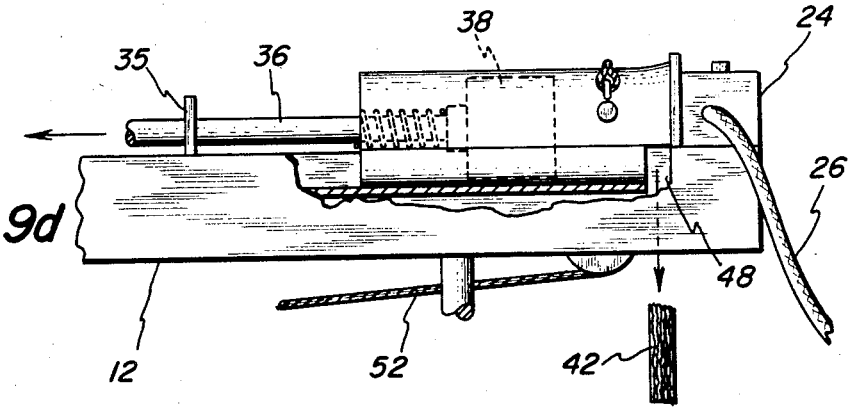

After first clutch means 78 and second clutch means 79 have been activated, ram rod 36 travels toward stationary anvil 32 causing ram head 38 to proceed to crush can 42 as shown in FIGS. 9*a*, 9*b*, 9*c* and 9*d*. Initially, as shown in FIG. 9*a*, ram head 38 contacts and pushes empty can 42 against anvil 32. The arrows, which indicate the direction of travel of ram rod 36, indicate that the empty can 42 is being crushed between ram head 38 and stationary anvil 32 as shown in FIG. 9*b*. When the ram rod 36 is in the full travel position, as shown in FIG. 9*c*, empty can 42 is completely crushed and is pressed between ram head 38 and anvil 32. The next step is shown in FIG. 9*d* which indicates that ram rod 36 reverses direction by moving towards the home position and thereby releases the crushed can 42 and permits it to fall through drop slot 48. The change in direction of the ram rod occurs by releasing the second clutch means 79 and also preferably the first clutch means also at about the same time. It is advantageous to facilitate release of crushed can 42 by beveling the end of loading door 46 slightly in an outward direction at that section of loading door 46 adjacent to anvil 32.

While this invention has been disclosed with respect to particular embodiments thereof, numerous modifications may be made by those skilled in the art without departing from its true spirit and scope. Therefore, it is intended that the appended claims cover all such modifications and variations which come within the true spirit and scope of the present invention.

I claim:

1. An apparatus for crushing a cylindrical can which comprises:

(a) a base, (b) a horizontal frame affixed to said base and having two opposed ends, (c) an anvil mounted near one end of said frame, (d) a movable ram positioned on said frame and facing said anvil, (e) a crushing chamber affixed to said frame for supporting said can in the horizontal position between the anvil and the ram, such that one end of said can is positioned adjacent said anvil and the other end of said can is positioned adjacent said ram, and (f) a drive means for moving the ram toward the anvil and includng a power means, a means for transmitting said power means to the movable ram, and means for engaging and disengaging said power means, to crush said can disposed therebetween, said drive means comprising a first drive mechanism including a driver pulley mounted on the motor shaft, a driven pulley mounted on a first shaft, and a belt operatively connecting the driver pulley to the driven pulley to impart rotational motion to the first shaft; a second drive mechanism including a first chain wheel mounted on said first shaft, a second chain wheel mounted on a second shaft and a drive chain for operatively connecting the first chain wheel to the second chain wheel and imparting rotational motion to the second shaft; and a third drive mechanism including a pinion gear mounted on said second drive shaft and a ram assembly slidably mounted on said horizontal frame, said ram assembly having the ram affixed to one end thereof and having a rack gear affixed to the other end of said rod, and (g) a means for moving said ram away from said anvil to allow removal of the crushed can.

2. The apparatus of claim 1, wherein the means for engaging and disengaging the power means includes a friction clutch lever and a third pulley located between the driver pulley and the driven pulley to provide sufficient tension on the belt and thereby engage the pulleys, and a second clutch means for engaging the pinion gear on the rack gear portion of the ram rod.

3. The apparatus of claim 2, wherein the crushing chamber has a semicylindrical bottom wall and a semicylindrical loading door hinged to said bottom wall which together define the dimensions of the crushing chamber.

4. The apparatus of claim 3, including connecting means affixed to said loading door and said second clutch means to engage said pinion gear with said rack gear when the loading door is closed and to disengage said pinion gear from said rack gear when the loading door is open.

5. The apparatus of claim 4, wherein said friction clutch lever includes a handle mounted to said frame for manually engaging the friction clutch lever.

6. The apparatus of claim 3, wherein said apparatus is characterized by a control mechanism operatively connected to said ram rod and responsive to a predetermined movement of said loading door in a direction toward the normal operating position thereof.

7. The apparatus of claim 3, wherein the semicylindrical bottom wall has a drop slot adjacent said anvil for removing the can from said chamber after the can has been crushed between the ram and said anvil.

8. The apparatus of claim 7, wherein the semicylindrical loading door has a portion beveled outwardly adjacent said anvil and above said drop slot.

9. The crushing chamber of claim 3, wherein said chamber has a horizontal axis and said ram moves in said chamber toward or away from said anvil along said horizontal axis.

10. The apparatus of claim 1, further including a counter means for recording the number of cans crushed during operation of said apparatus.

* * * * *